US005865611A

United States Patent [19]

Maiello

[11] Patent Number: 5,865,611

[45] Date of Patent: Feb. 2, 1999

[54] FUEL-FIRED MODULATING FURNACE CALIBRATION APPARATUS AND METHODS

[75] Inventor: Dennis R. Maiello, Fort Smith, Ark.

[73] Assignee: Rheem Manufacturing Company, New York, N.Y.

[21] Appl. No.: 727,884

[22] Filed: Oct. 9, 1996

[51] Int. Cl.[6] ..... F23N 11/44; F24H 3/00

[52] U.S. Cl. ..... 431/12; 431/2; 126/116 A; 126/116 E

[58] Field of Search ..... 431/2, 12, 18; 126/116 A, 110 E

[56] References Cited

U.S. PATENT DOCUMENTS

| | | | |
|---|---|---|---|
| 4,192,641 | 3/1980 | Nakagawa et al. | 431/15 |
| 4,334,855 | 6/1982 | Nelson | 431/20 |
| 4,421,268 | 12/1983 | Bassett et al. | 236/91 F |
| 4,445,638 | 5/1984 | Connell et al. | 237/8 R |
| 4,502,625 | 3/1985 | Mueller | 236/11 |
| 4,519,540 | 5/1985 | Boulle et al. | 237/7 |
| 4,533,315 | 8/1985 | Nelson | 431/20 |
| 4,547,150 | 10/1985 | Vereecke | 432/12 |
| 4,583,936 | 4/1986 | Krieger | 431/1 |
| 4,588,372 | 5/1986 | Torborg | 431/78 |
| 4,602,610 | 7/1986 | McGinnis | 126/110 E |
| 4,638,942 | 1/1987 | Ballard et al. | 236/10 |
| 4,676,734 | 6/1987 | Foley | 431/12 |
| 4,688,547 | 8/1987 | Ballard et al. | 126/116 A |
| 4,706,881 | 11/1987 | Ballard | 236/15 BD |
| 4,707,646 | 11/1987 | Thompson et al. | 318/332 |
| 4,729,207 | 3/1988 | Dempsey et al. | 126/112 |
| 4,789,330 | 12/1988 | Ballard et al. | 431/75 |
| 4,792,089 | 12/1988 | Ballard | 236/11 |
| 4,815,524 | 3/1989 | Dempsey et al. | 165/12 |
| 4,962,749 | 10/1990 | Dempsey et al. | 126/116 A |
| 5,001,640 | 3/1991 | Matsumoto et al. | 364/426.02 |
| 5,027,789 | 7/1991 | Lynch | 126/116 A |
| 5,037,291 | 8/1991 | Clark | 431/12 |
| 5,112,217 | 5/1992 | Ripka et al. | 431/12 |
| 5,123,080 | 6/1992 | Gillett et al. | 388/934 |
| 5,169,301 | 12/1992 | Donnelly et al. | 431/20 |
| 5,206,566 | 4/1993 | Yoshida et al. | 318/568.22 |
| 5,248,083 | 9/1993 | Adams et al. | 236/11 |
| 5,307,990 | 5/1994 | Adams et al. | 236/11 |
| 5,377,909 | 1/1995 | Kirkpatrick | 236/11 |
| 5,379,752 | 1/1995 | Virgil, Jr. et al. | 126/116 A |
| 5,417,133 | 5/1995 | Jamieson et al. | 126/110 AA |
| 5,590,642 | 1/1997 | Borgeson et al. | 126/116 A |
| 5,666,889 | 9/1997 | Evens et al. | 110/190 |
| 5,732,691 | 3/1998 | Maiello et al. | 126/116 A |

OTHER PUBLICATIONS

Rheem "New Imperial Gas Furnace" Brochure Materials (1969).

Rheem Furnace Wiring And Instructional Materials (1969).

Rheem "Solid–State Breakthrough" Publication (1969).

*Primary Examiner*—Larry Jones

*Attorney, Agent, or Firm*—Konneker & Smith, P.C.

[57] ABSTRACT

A gas-fired air heating furnace has a modulatable supply air blower and a modulatable gas valve operatively connected to the combustion air heat exchanger burner. A calibration sequence of a microprocessor-based control system is utilized to automatically determine the precise relationship between the gas valve setting and the actual heat transferred by the heat exchanger to air flowing through the furnace by measuring the actual air temperature rise across the heat exchanger obtained using initial calibration settings of the blower and gas valve. The microprocessor uses the results of its calibration sequence to establish an adjustment correlation between the blower and gas valve settings which the microprocessor subsequently utilizes to adjust the flow rates of the blower and the gas valve in a manner maintaining a predetermined, generally constant air temperature rise across the heat exchanger while the furnace alters its overall air heating output rate in response to changing heating demands from the conditioned space served by the furnace.

13 Claims, 2 Drawing Sheets

FUEL-FIRED MODULATING FURNACE CALIBRATION APPARATUS AND METHODS

BACKGROUND OF THE INVENTION

The present invention generally relates to the control of heat transfer apparatus and, in a preferred embodiment thereof, more particularly relates to control and calibration apparatus and methods for use in conjunction with fuel-fired air heating furnaces having modulatable fuel valves and supply air blowers.

In the design of fuel fired air heating furnaces that heat and deliver recirculating air to a conditioned space making variable heating demands on the furnace, two separate operational design challenges are typically presented—namely (1) the comfort of the occupants in the conditioned space served by the furnace, and (2) the operational stability of the various components of the furnace. From the comfort standpoint, for example, an air delivery temperature that is either too cool or too hot may be perceived by a conditioned space occupant as uncomfortable even though the changing heating demands of the conditioned space are, from a heat delivery perspective, being precisely met by the furnace. From the standpoint of furnace operational stability, it is desirable to avoid wide variations in, for example, the flow rate ratio of external supply air and internal combustion products traversing the heat exchanger portion of the furnace.

Yet in conventionally controlled furnaces it is typically difficult to satisfy each of these two operational design parameters—typically, an improvement in one tends to at least somewhat degrade the other. It is accordingly an object of the present invention to provide a fuel fired air heating furnace, and associated control system, that enables the furnace to provide both improved conditioned space occupant comfort levels, and enhanced operational stability for the furnace itself, compared to typical fuel fired air heating furnaces of conventional design.

SUMMARY OF THE INVENTION

In carrying out principles of the present invention, in accordance with a preferred embodiment thereof, a fuel fired heat transfer apparatus, representatively a gas fired air heating furnace, is provided with a specially designed calibration and control system that is operative to regulate the operation of the furnace in a manner maintaining a predetermined, generally constant heated air supply temperature delivered to the conditioned space served by the furnace while varying the furnace heat transferred to and the flow rate of the supply air in response to changing heating demands from the conditioned space.

The gas fired furnace has a modulatable supply air blower adjustable to recirculate a selectively variable flow of air to and from a conditioned space served by the furnace, and a fuel fired heat exchanger positioned in the path of the recirculating air. A fuel burner is connected to the heat exchanger and is operative to receive fuel from a source thereof and responsively flow a flame and resulting hot combustion gases into the heat exchanger. A modulatable fuel supply valve is operatively connected to the fuel burner and is adjustable to permit a selectively variable fuel inflow rate to the fuel burner.

The furnace control system is operative to modulate the supply air blower and the fuel supply valve in a correlated manner maintaining the air temperature rise across the heat exchanger at a predetermined, generally constant magnitude, the control system including calibration means operable to establish the necessary correlation between the settings of the supply air blower and the fuel supply valve.

In a preferred embodiment thereof, the calibration means include (1) means for adjusting the flow rates of the supply air blower and the fuel supply valve to initial calibration settings thereof; (2) means for measuring the resulting steady state air temperature rise across the heat exchanger; (3) means for utilizing the measured steady state air temperature rise to establish the relationship between the fuel supply valve setting and the actual heat transferred to the air by the heat exchanger; and (4) means for using the established relationship to determine the necessary correlation between the settings of the supply air blower and the fuel supply valve to maintain the desired constant air temperature rise across the heat exchanger.

Representatively, the control system and calibration means include first and second temperature sensing means for sensing the air temperature rise across the heat exchanger, and a microprocessor operatively coupled to the first and second temperature sensing means, the supply air blower, and the fuel supply valve.

In a preferred embodiment of the furnace regulation method carried out by the control system and calibration means, the microprocessor, during its initial calibration sequence, sets the supply blower at a predetermined calibration air mass flow delivery rate and sets the fuel valve at a calibration flow rate based on a thermal equilibrium relationship among the initial blower air mass flow delivery rate calibration setting, the desired air temperature rise across the heat exchanger, and a calculated value of the necessary fuel valve setting based upon an assumed heat exchanger output/gas valve setting correlation obtained, for example, from the "nameplate" heating rating of the furnace.

With the blower and fuel valve adjusted to these initial calibration settings, the first and second temperature sensing means are used to measure the subsequent steady state actual air temperature rise across the heat exchanger. The microprocessor automatically determines the difference between the actual air temperature rise and the desired air temperature rise and responsively adjusts the air delivery rate of the supply blower to achieve the desired air temperature rise across the heat exchanger.

Next, the microprocessor determines from the aforementioned thermal equilibrium relationship (preprogrammed into the microprocessor) the precise relationship between the fuel valve setting and the actual resulting rate of heat transfer from the heat exchanger to the air traversing it during firing of the burner. From this determination the microprocessor determines the correlation between the fuel valve setting and the supply air blower setting and makes correlated adjustments in these two settings, in response to changes in heating demand from the conditioned space served by the furnace, in a manner causing the furnace operating point to "track" along a predetermined constant air temperature rise curve.

While it is preferred in the calibration sequence to initially set the blower flow rate, adjust the fuel valve to an initial calibration setting, measure the resulting air temperature rise across the heat exchanger, and then adjust the blower flow rate to achieve the desired air temperature rise, other calibration sequences could be utilized if desired. For example, the fuel valve could be adjusted to a calibration setting first, and the blower setting then calculated and established before the actual air temperature rise is measured and adjusted by a readjustment of the blower setting. Additionally, whether the blower or fuel valve is adjusted to a calibration setting first before the actual air temperature rise is measured, the fuel valve setting (instead of the blower setting) can be readjusted to raise or lower the actual air temperature rise to the desired value thereof.

Although principles of the present invention are representatively illustrated and described herein as being incorporated in a fuel-fired air heating furnace, illustratively a gas furnace, they could also be used to advantage in heat transfer apparatus of other types utilizing, for example, (1) a liquid fuel, and/or (2) a liquid recirculating medium to which heat is to be transferred, and/or (3) the cooling of the recirculating medium instead of the heating thereof.

DETAILED DESCRIPTION

Figure 1:
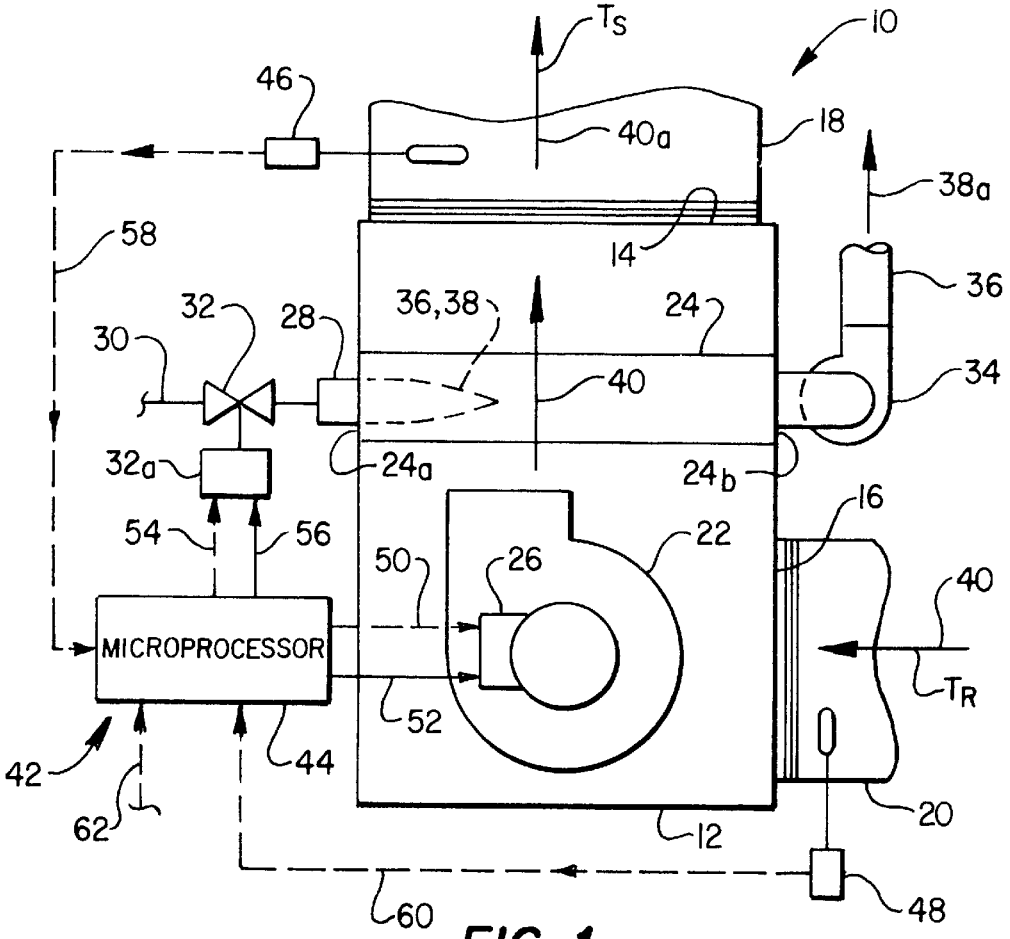
FIG. 1 is a highly schematic diagram of a representative gas-fired furnace having a modulatable gas valve and supply air blower, and further having incorporated therein a specially designed constant air temperature difference control and calibration system embodying principles of the present invention.

Illustrated in schematic form in FIG. 1 is a fuel-fired heating appliance, representatively a gas-fired, forced flow air heating furnace 10, embodying principles of the present invention. Furnace 10 is illustratively of an upflow type and has a generally rectangular housing 12 with a supply air discharge opening 14 formed in its top end, and a return air inlet opening 16 formed in a lower right side portion thereof. A supply air duct 18 is connected to the discharge opening 14 and extends to a conditioned space (not shown) served by the furnace 10, and a return air duct 20 is connected to the inlet opening 16 and also extends to the conditioned space.

An electric motor-driven supply air blower 22 is disposed within a bottom portion of the housing 12 beneath a combustion heat exchanger 24 having an inlet end 24*a* and an outlet end 24*b*. The air delivery rate of the supply air blower 22 is modulatable via a duty cycle type motor controller 26 operatively associated with the blower. A suitable gas burner 28 is supported at the inlet end 24*a* of the heat exchanger 24 and is served by a gas supply line 30 in which a modulatable gas valve 32 is operably interposed. Gas valve 32 is representatively of the DC milliamp, constant current control type and has an associated modulation control section 32*a*. The inlet of a draft inducer fan 34 is coupled to the outlet 24*b* of the heat exchanger 34 and has its outlet connected to a suitable combustion products vent stack 36. Draft inducer fan 34 may be of a single speed, multiple discrete speed type, or of a fully modulatable speed type.

During operation of the furnace 10, gaseous fuel from the valve 32 is flowed into the burner 28, mixed with combustion air (not shown) and ignited to create a flame 36 and associated hot combustion gases 38 that are drawn into the inlet end 24*a* of the heat exchanger 24, and flowed rightwardly through the heat exchanger 24, by the operation of the draft inducer fan 34. At the same time, the blower 22 draws air 40 from the conditioned space through the return air duct 20 into the interior of the housing 12, forces the air 40 upwardly and externally across the heat exchanger 24 to absorb heat therefrom and create heated supply air 40*a*, and flow the heated supply air 40*a* back to the conditioned space via the supply air duct 18. The heat transfer from the heat exchanger 24 to the air 40 cools the internal heat exchanger combustion gases 38, with the cooled gases 38*a* being discharged into the vent stack 36 by the draft inducer fan 34.

The operation of the furnace 10 is regulated, to very efficiently maintain a desired difference between the temperature $T_S$ of the heated supply air 40*a* and the lesser temperature $T_R$ of the return air 40, utilizing a specially designed calibration and control system 42 embodying principles of the present invention. Calibration and control system 42 includes a microprocessor 44 operatively linked to the blower motor controller 26 and the modulation control section 32*a* of the gas valve 32; a temperature sensor 46 operative to sense the temperature $T_S$ of the supply air 40*a* in the supply duct 18 and linked to the microprocessor 44; and a temperature sensor 48 operative to sense the temperature $T_R$ of the air 40 in the return duct 20.

Microprocessor 44 is operative, as later described herein, to (1) transmit calibration and control signals 50,52 to the blower motor controller 26; (2) transmit calibration and controls 54,56 to the modulation control section 32*a* of the gas valve 32; (3) receive a temperature magnitude signal 58 from the supply air temperature sensor 46; (4) receive a temperature magnitude signal 60 from the return air temperature sensor 48; and (5) receive a heating demand signal 62 from a suitable conditioned space temperature sensing device (not shown).

Various data, thermodynamic relationships and operational curve characteristics are preprogrammed into the microprocessor 44 in a suitable manner. For example, the following basic thermodynamic equilibrium relationship for the furnace is preprogrammed into the microprocessor 44:

$$Q=c_p(M_B)(T_S-T_R)$$

wherein:

Q=the air heating rate of the furnace, $c_p$=the specific heat of air (assumed constant), $M_B$=the blower air mass flow delivery rate, and $T_S-T_R$=the heated air temperature rise.

Additionally preprogrammed into the microprocessor 44 are the "shapes" of various operating curves, such as the representatively illustrated family of constant temperature rise curves $CT_1$–$CT_4$ in the blower cfm setting vs. gas valve setting GV graphs in FIGS. 2A and 2B subsequently discussed herein, and the gas valve response characteristic curve GVRC shown in the gas valve setting vs. burner heat output graph in FIG. 3 subsequently discussed herein, as well as various operational data relating the blower 22 and its motor controller 26.

As will now be described, the calibration and control system 42 functions to provide the furnace 10 with a desirably high degree of operational stability, as well as providing the occupants of the conditioned area served by the furnace 10 with enhanced comfort, by maintaining a generally constant operational air temperature rise across the furnace (and thus, for a given conditioned space temperature control setting, a generally constant heated delivery temperature) despite variations in heat demand for the conditioned space. These dual goals of furnace operational stability and conditioned space occupant comfort are achieved by utilizing the control system 42 to sense various of the furnace's operating parameters and, in response to changes in conditioned space heating demand, automatically making simultaneous adjustments of the gas valve and supply blower settings to maintain the predetermined air temperature differential across the furnace.

Operation of the Calibration and Control System 42

As can be seen in the previously described thermodynamic equilibrium equation $Q=c_p(M_B)(T_S-T_R)$, there are three variables in the equation—namely, the furnace air heating rate Q, the blower air mass flow delivery rate $M_B$, and the heated air temperature rise $T_S-T_R$ which is the variable operating parameter that is desired to be maintained at an essentially constant magnitude for each heating demand rate encountered in the operation of the furnace 10. From a broad perspective, the basic premise of the constant air temperature rise control of the furnace 10 using principles of the present invention is that for a given desired heated air temperature rise (for example 65° F.) and a selected value of one of the other two variable equation parameters (e.g., the blower air mass flow delivery rate $M_B$) the value of the remaining variable equation parameter (e.g., the furnace air heating input rate Q) is established. As will be subsequently described herein, the microprocessor 44 uses this thermodynamic equilibrium relationship preprogrammed thereinto to adjust both the air mass flow rate setting of the blower 22 and the setting "GV" of the gas valve 32 in a manner maintaining a constant air temperature rise across the furnace 10 despite increased or decreased heating demands from the conditioned space.

For the particular blower 22 installed in the furnace 10 there is a direct and known relationship (which is part of the date preprogrammed into the microprocessor 44) between the duty cycle selected for the motor controller 26 and the flow rate of air delivered from the blower 22. A selected magnitude of the microprocessor control output signal 52 thus results in a known, actual air delivery rate of the blower 22.

With respect to the actual heat transferred to the air 40 by the heat exchanger 24 there is not such a known, essentially nonvariable correlation between the selected gas valve setting GV and the heat output of the burner 28 and resulting combustion heat transfer to the air 40. This is due to the fact that the actual combustion heat transferred to the air 40 is dependent on three variable factors—namely, (1) the manifold pressure of the gaseous fuel supplied to the valve 32 via the supply pipe 30, (2) the actual heating value of the gaseous fuel being used, and (3) the size of the manifold orifice associated with the gas valve 32. Despite the fact that the furnace 10 typically has a "nameplate" heating capacity (i.e., the maximum rated heating capacity of the furnace for a particular type of fuel), any or all three of these furnace heating capacity factors may vary in the field.

Thus, the precise relationship between the gas valve setting GV and the resulting actual rate of furnace combustion heat transfer to the air 40 is typically not known. According to a key aspect of the present invention, however, this relationship is automatically determined by the microprocessor 44 which uses such determined gas valve setting/actual furnace heating output ratio to precisely control the operation of the furnace by adjusting both the gas valve setting and the blower output setting in a manner causing the thermal operating equilibrium point of the furnace to "track" along a selected constant heated air temperature line, in response to heating demand changes, as will now be described.

Figure 2A:
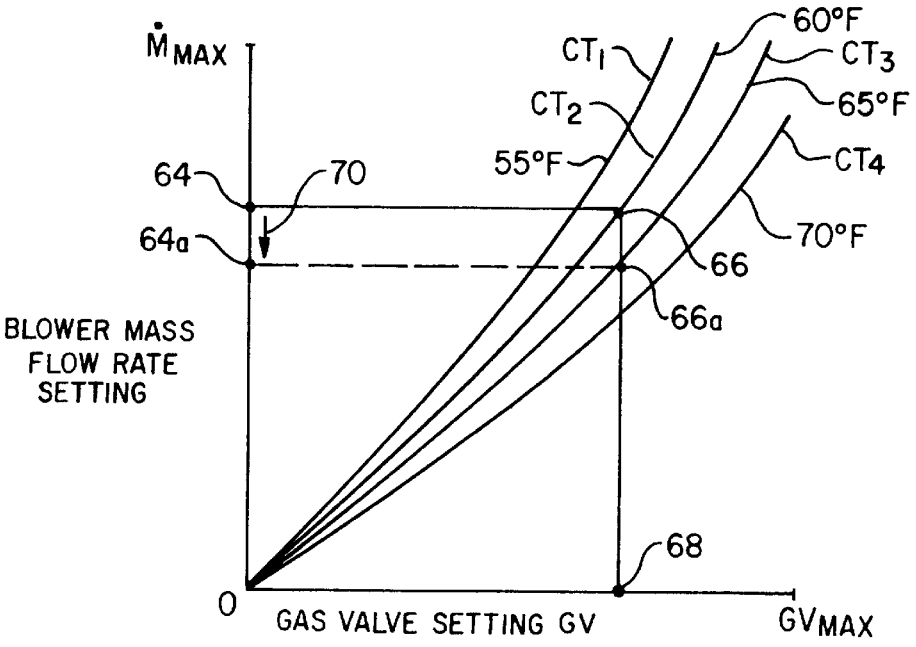
FIGS. 2A, 2B and 3 are graphs illustrating various calibration steps performable by the control and calibration system.

Turning additionally now to the graph in FIG. 2A, using a time clock incorporated therein the microprocessor 44 periodically transmits the predetermined calibration signal 50 to the blower motor controller 26 to temporarily fix the blower air mass flow delivery rate setting at point 64 on the FIG. 2 graph. Based on the desired supply air temperature rise across the furnace 10 (for example, 65° F.) and the previously discussed thermodynamic equilibrium relationship preprogrammed into the microprocessor 44, the microprocessor calculates the theoretical gas valve setting GV needed to make the steady state operating point 66 of the furnace 10 fall on the constant 65° F. temperature rise line $CT_3$ based on the assumption that the maximum heat output of the burner 28 (at $GV_{max}$) is the "nameplate" heat output rate of the furnace. The microprocessor 44 then outputs the calibration signal 54 to the gas valve modulation control section 32*a*, thereby establishing the gas valve setting point 68 shown on the FIG. 2A graph.

Next, the microprocessor 44 permits the furnace 10 to run until it achieves a steady state of operation, thereby establishing the actual operating point 66. At this time, the output signals 58,60 transmitted from the temperature supply and return air temperature sensors 46,48 to the microprocessor are compared by the microprocessor to determine (via the previously discussed thermodynamic equilibrium equation stored in the microprocessor) the actual air temperature rise across the furnace 10. In the calibration example shown in FIG. 2A it has been assumed that the actual steady state operating point 66 achieved during the calibration mode of the control system 42 falls on the constant 60° F. temperature difference curve $CT_2$ instead of the desired and theoretically predicted constant 65° temperature difference curve $CT_3$.

Using the known blower air mass flow delivery rate and the now known actual air temperature rise across the furnace, the microprocessor 44 then adjusts the blower setting, as indicated by the arrow 70 in FIG. 2A, to blower air mass flow delivery rate setting point 64*a* in a manner moving the furnace operating point 66 to point 66*a* on the desired 65° F. constant temperature rise curve $CT^3$. Turning now to the graph of FIG. 3, via the equilibrium equation $Q=c_p(M_B)(T_S-T_R)$ the microprocessor 44 calculates from the known blower air mass flow delivery rate (corresponding to point 64*a* on the FIG. 2A graph) and the known air temperature rise across the furnace (corresponding to the point 66*a* on the FIG. 2A graph) the actual burner heat output to the air 40.

Figure 3:
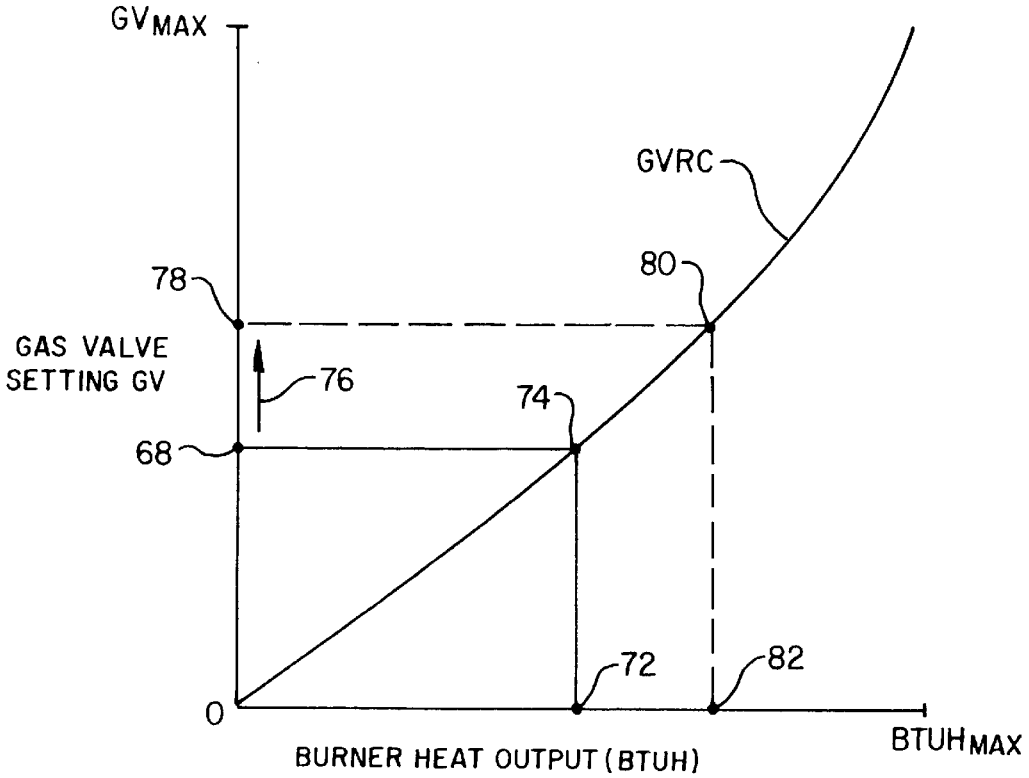

The known gas valve setting point 68 and the microprocessor-calculated burner heat output point 72 establish the gas valve setting/burner heat output correlation point 74 on the FIG. 3 graph, and thus establish a point on the FIG. 3 graph through which the gas valve response curve GVRC (whose "shape" is preprogrammed into the microprocessor 44) passes. As can be seen, this in turn establishes the position of the GVRC curve on the FIG. 3 graph, thereby mathematically establishing, via operation of the microprocessor 44, a precise calibration correlation between each selected gas valve setting and the resulting actual rate of heat transferred by the furnace to air traversing the furnace—i.e., the parameter "Q" in the thermodynamic equilibrium equation preprogrammed into the microprocessor.

With reference now to FIGS. 1 and 3, when the heating demand signal 62 (see FIG. 1) received by the microprocessor 44 from the conditioned space calls for increased heat to the conditioned space, the gas valve setting GV is automatically increased (as indicated by the arrow 76 in FIG. 3) via the microprocessor output signal 56 to a higher setting point 78. Via the resulting horizontally intersected point 80 on the previously positioned gas valve response characteristic curve GVRC, the microprocessor 44 calculates the actual rate of heat Q being transferred to the furnace-recirculated air 40 corresponding to the increased burner heat output point 82 on the FIG. 3 graph.

Using this new actual Q value, corresponding to the adjusted gas valve setting GV, together with the previously established desired constant air temperature drop $(T_S-T_R)$, the microprocessor calculates the corresponding blower air mass flow delivery rate $M_B$ and outputs the control signal 52 to the motor controller 26 to achieve the necessary blower air mass flow delivery rate. As can be seen, using this unique method, the calibration and control system 42 of the present invention maintains the furnace operating point on a predetermined constant air temperature rise curve by modulating both the gas valve 32 and the supply air blower 22.

With respect to the blower air mass flow delivery rate and gas valve setting parameters regulated by the microprocessor 44 in the calibration and control technique described above, various alternate calibration sequences could be utilized if desired. For example, in the calibration process illustrated in FIG. 2A, the gas valve setting point 68 could be established first, and the theoretical blower cfm setting 64 then be calculated and set by the microprocessor 44 before adjusting the blower air mass flow delivery rate setting point to point 64*a* after measuring the actual air temperature rise across the furnace.

Figure 2B:
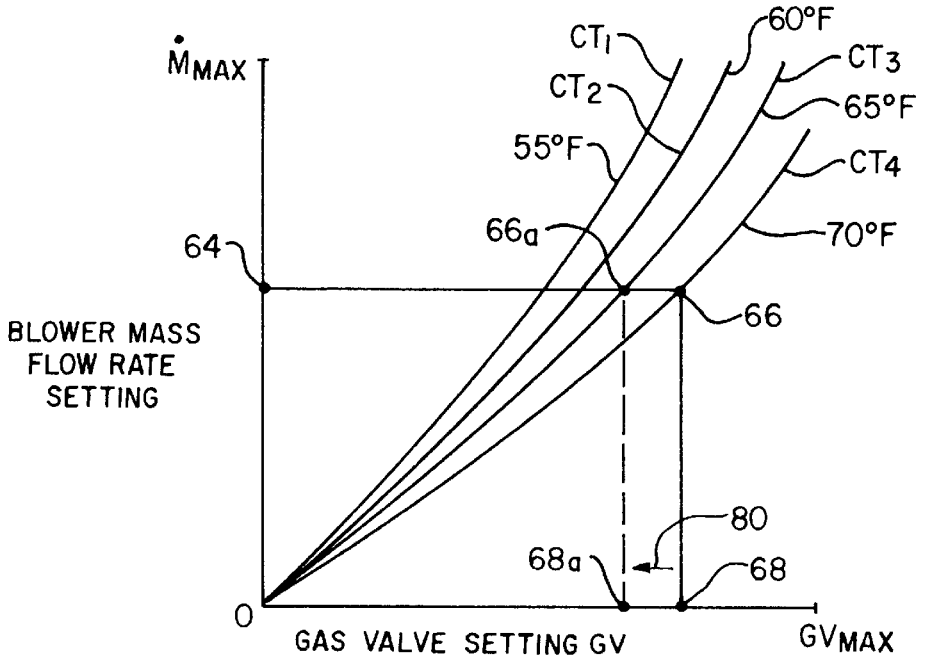

Another alternate calibration method is graphically depicted in FIG. 2B and entails the initial microprocessor establishment of the blower cfm setting point 64 and the subsequent calculation and establishment of the theoretical gas valve setting point 68 based on the desired constant air temperature rise (representatively 65° F.) across the furnace. Via the temperature sensor signals 58,60 received by the microprocessor 44 the actual furnace air temperature rise at point 66 (illustratively 70 °) is measured by the microprocessor which responsively adjusts the gas valve setting from point 68 to point 68*a*, as indicated by the arrow 80 in FIG. 2B, to establish a new furnace operating point 66*a* on the desired 65° F. constant temperature rise curve $CT_3$ as shown. The microprocessor 44 then calculates the precise gas valve setting-to-actual air heating rate relationship, in the manner previously described in conjunction with FIG. 3, and uses this calculated relationship to subsequently modulate the gas valve 32 and the blower 32 in a manner causing the furnace operating point to "track" along a constant air temperature rise curve in response to various changes in conditioned space heating demand.

If desired, in the calibration method graphically depicted in FIG. 2B, the gas valve setting point 68 could be set first, and the initial blower air mass flow delivery rate setting theoretically calculated and set after the establishment of the gas valve setting 68. The subsequent actual steady state air temperature rise could then be measured and the microprocessor used to shift the gas valve setting from point 68 to point 68*a* as described above.

As can readily be seen from the foregoing, the present invention provides the furnace 10, via its calibration and control system 42, with operational characteristics yielding both an enhanced level of conditioned space occupant comfort due to the automatic provision of an essentially constant supply air temperature over the heating demand range of the conditioned space, and a substantially increased degree of operational stability for the furnace due to the precisely correlated modulation of both the supply air blower 22 and the gas valve 32.

While the foregoing detailed description has been representatively directed to an air heating apparatus utilizing a gaseous fuel, it will be readily appreciated by those of skill in this particular art that principles of the present invention could also be advantageously utilized in conjunction with heat transfer apparatus of other types utilizing, for example, (1) a liquid fuel, and/or (2) a liquid recirculating medium to which heat is to be transferred, and/or (3) the cooling of the recirculating medium instead of the heating thereof.

The foregoing detailed description is to be clearly understood as being given by way of illustration and example only, the spirit and scope of the present invention being limited solely by the appended claims.

What is claimed is:

1. Heat transfer apparatus subjectable to a variable heat transfer demand load and comprising:

recirculating means for recirculating a fluid medium through a flow path;

first adjustment means associated with said recirculating means and operable to selectively vary the mass flow rate of the fluid medium through said flow path;

a heat exchanger interposed in said flow path to be traversed by fluid medium flowing therethrough;

fuel-fired means, connected to said heat exchanger, for receiving fluid fuel from a source thereof and utilizing the received fuel to create a heat exchange between said heat exchanger and the fluid medium traversing said heat exchanger and a corresponding temperature change in the fluid medium traversing said heat exchanger;

second adjustment means associated with said fuel-fired means and operable to selectively vary the amount of fluid fuel received by said fuel-fired means; and calibration and control means for automatically adjusting each of said first and second adjustment means to accommodate changes in said variable heat transfer demand load, said calibration and control means being operative to:

set one of said first and second adjustment means to a predetermined calibration setting thereof, calculate a theoretical setting for the other of said first and second adjustment means based on an assumed relationship between the setting of said second adjustment means and the resulting magnitude of heat transfer between said heat exchanger and the recirculating fluid medium, adjust said other of said first and second adjustment means to said theoretical setting, determine the actual fluid medium temperature differential resulting from said calibration and theoretical settings, change the determined actual fluid medium temperature differential to a desired fluid medium temperature differential magnitude by adjusting one of said first and second adjustment means to a second setting thereof, use the settings of said first and second adjustment means with the fluid medium temperature differential at said desired magnitude thereof to determine the actual relationship between the setting of said second adjustment means and the resulting magnitude of heat transfer between said heat exchanger and the recirculating fluid medium, utilize the determined actual relationship between the setting of said second adjustment means and the resulting magnitude of heat transfer between said heat exchanger and the recirculating fluid medium to establish a correlation between the settings of said first and second adjustment means which will maintain the desired fluid medium temperature differential magnitude, alter the setting of one of said first and second adjustment means in response to a change in heat transfer demand load for said heat transfer apparatus, and alter the setting of the other of said first and second adjustment means in accordance with the established correlation between the settings of said first and second adjustment means.

2. The heat transfer apparatus of claim 1 wherein:

said heat transfer apparatus is a fuel-fired heating furnace, said fluid medium is air, said recirculating means include a modulatable motor-driven supply air blower, said first adjustment means include a motor controller, said fuel-fired means include a fuel burner positioned to flow a flame and resulting hot combustion gases into said heat exchanger, and said second adjustment means include a modulatable fuel valve operatively connected to said fuel burner.

3. The heat transfer apparatus of claim 2 wherein:

said fuel-fired heating furnace is a gas fired heating furnace, said fuel burner is a gas burner, and said fuel valve is a gas valve.

4. The heat transfer apparatus of claim 2 wherein said calibration and control means include:

a first temperature sensor operative to sense the temperature of recirculating air moving toward said heat exchanger, a second temperature sensor operative to sense the temperature of recirculating air moving away from said heat exchanger, and a microprocessor operatively coupled to said first and second temperature sensors, said fuel valve and said motor controller, and adapted to receive a heat transfer demand signal from a conditioned space served by said fuel-fired heating furnace.

5. For use in conjunction with a heat transfer apparatus subjectable to a variable heat transfer demand load and including recirculating means for recirculating a fluid medium through a flow path, first adjustment means associated with said recirculating means and operable to selectively vary the mass flow rate of the fluid medium through said flow path, a heat exchanger interposed in said flow path to therethrough, by fluid medium flowing therethrough, fuel-fired means, connected to said heat exchanger, for receiving fluid fuel from a source thereof and utilizing the received fuel to create a heat exchange between said heat exchanger and the fluid medium traversing said heat exchanger and a corresponding temperature change in the fluid medium traversing said heat exchanger, and second adjustment means associated with said fuel-fired means and operable to selectively vary the amount of fluid fuel received by said fuel-fired means, a method of controlling the operation of said heat transfer apparatus, said method comprising the steps of:

setting one of said first and second adjustment means to a predetermined calibration setting thereof, calculating a theoretical setting for the other of said first and second adjustment means based on an assumed relationship between the setting of said second adjustment means and the resulting magnitude of heat transfer between said heat exchanger and the recirculating fluid medium, adjusting said other of said first and second adjustment means to said theoretical setting, determining the actual fluid medium temperature differential resulting from said calibration and theoretical settings, changing the determined actual fluid medium temperature differential to a desired fluid medium temperature differential magnitude by adjusting one of said first and second adjustment means to a second setting thereof, using the settings of said first and second adjustment means with the fluid medium temperature differential at said desired magnitude thereof to determine the actual relationship between the setting of said second adjustment means and the resulting magnitude of heat transfer between said heat exchanger and the recirculating fluid medium, utilizing the determined actual relationship between the setting of said second adjustment means and the resulting magnitude of heat transfer between said heat exchanger and the recirculating fluid medium to establish a correlation between the settings of said first and second adjustment means which will maintain the desired fluid medium temperature differential magnitude, altering the setting of one of said first and second adjustment means in response to a change in heat transfer demand load for said heat transfer apparatus, and altering the setting of the other of said first and second adjustment means in accordance with the established correlation between the settings of said first and second adjustment means.

6. A fuel fired air heating furnace comprising:

a modulatable supply air blower adjustable to recirculate a selectively variable flow of air to and from a conditioned space served by the furnace;

a fuel fired heat exchanger positioned in the path of the recirculating air;

a fuel burner connected to said heat exchanger and operative to receive fuel from a source thereof and responsively flow a flame and resulting hot combustion gases into said heat exchanger;

a modulatable fuel supply valve operatively connected to said fuel burner and being adjustable to permit a selectively variable fuel inflow rate to said fuel burner; and a control system for modulating said supply air blower and said fuel supply valve in a correlated manner maintaining the air temperature rise across said heat exchanger at a predetermined, generally constant magnitude, said control system including calibration means operable to establish the necessary correlation between the settings of said supply air blower and said fuel supply valve, said calibration means including:

means for adjusting the flow rates of said supply air blower and said fuel supply valve to initial calibration settings thereof, means for measuring the resulting steady state air temperature rise across said heat exchanger, means for utilizing the measured steady state air temperature rise to establish the relationship between the fuel supply valve setting and the actual heat transferred to the air by said heat exchanger, and means for using said established relationship to determine said necessary correlation between the settings of said supply air blower and said fuel supply valve.

7. The fuel fired air heating furnace of claim 6 wherein said control system and calibration means include:

first temperature sensing means for sensing the temperature of recirculating air flowing toward said heat exchanger, second temperature sensing means for sensing the temperature of recirculating air flowing away from said heat exchanger, and a microprocessor operatively coupled to said first temperature sensing means, said second temperature sensing means, said supply air blower, and said fuel supply valve.

8. A method of operating a fuel fired air heating furnace having a modulatable supply air blower adjustable to recirculate a selectively variable flow of air to and from a conditioned space served by the furnace, a fuel fired heat exchanger positioned in the path of the recirculating air, a fuel burner connected to said heat exchanger and operative to receive fuel from a source thereof and responsively flow a flame and resulting hot combustion gases into said heat exchanger, and a modulatable fuel supply valve operatively connected to said fuel burner and being adjustable to permit a selectively variable fuel inflow rate to said fuel burner, said method comprising the steps of:

adjusting the flow rates of said supply air blower and said fuel supply valve to initial calibration settings thereof, measuring the resulting steady state air temperature rise across said heat exchanger;

utilizing the measured steady state air temperature rise to establish the relationship between the fuel supply valve setting and the actual heat transferred to the air by said heat exchanger;

using said established relationship to determine a correlation between the settings of said supply air blower and said fuel supply valve necessary to maintain a predetermined, generally constant air temperature rise across said heat exchanger for each setting of either of said supply air blower and said fuel supply valve; and modulating said supply air blower and said fuel supply valve, in accordance with said correlation, in response to a change in heating demand from a conditioned space served by said fuel fired air heating furnace.

9. A method of operating a fuel fired air heating furnace having a modulatable supply air blower adjustable to recirculate a selectively variable flow of air to and from a conditioned space served by the furnace, a fuel fired heat exchanger positioned in the path of the recirculating air, a fuel burner connected to said heat exchanger and operative to receive fuel from a source thereof and responsively flow a flame and resulting hot combustion gases into said heat exchanger, and a modulatable fuel supply valve operatively connected to said fuel burner and being adjustable to permit a selectively variable fuel inflow rate to said fuel burner, said method comprising the steps of:

adjusting the flow rates of said supply air blower and said fuel supply valve to initial calibration settings thereof, measuring the resulting steady state air temperature rise across said heat exchanger;

utilizing the measured steady state air temperature rise to establish the relationship between the fuel supply valve setting and the actual heat transferred to the air by said heat exchanger;

using said established relationship to determine a correlation between the settings of said supply air blower and said fuel supply valve necessary to maintain a predetermined, generally constant air temperature rise across said heat exchanger for each setting of either of said supply air blower and said fuel supply valve; and modulating said supply air blower and said fuel supply valve, in accordance with said correlation, in response to a change in heating demand from a conditioned space served by said fuel fired air heating furnace, said steps of adjusting the flow rates, measuring the resulting steady state air temperature rise, and utilizing the measured steady state air temperature rise being performed by:

adjusting the flow rate of one of said supply air blower and said fuel supply valve to a calibration setting, adjusting the flow rate of the other of said supply air blower and said fuel supply valve to a calibration setting based on a thermodynamic equilibrium relationship among the adjusted flow rate of said one of said supply air blower and said fuel supply valve, a desired air temperature rise across said heat exchanger, and the adjusted flow rate of said other of said supply air blower and said fuel supply valve, measuring the actual resulting steady state air temperature rise across said heat exchanger, changing the adjusted flow rate calibration setting of one of said supply air blower and said fuel supply valve to change the actual air temperature rise across said heat exchanger to the desired air temperature rise across said heat exchanger, and utilizing the relationship between the calibration settings of said supply air blower and said fuel supply valve, while the air temperature rise across said heat exchanger is equal to the desired air temperature rise, to determine the correlation between the calibration setting of said fuel supply valve and the actual heat transferred to the air by said heat exchanger.

10. The method of claim 9 wherein:

said step of adjusting the flow rate of one of said supply air blower and said fuel supply valve to a calibration setting is performed by adjusting the flow rate of said supply air blower to a calibration setting, and said step of changing the adjusted flow rate calibration setting of one of said supply air blower and said fuel supply valve is performed by changing the adjusted flow rate calibration setting of said supply air blower.

11. The method of claim 9 wherein:

said step of adjusting the flow rate of one of said supply air blower and said fuel supply valve to a calibration setting is performed by adjusting the flow rate of said supply air blower to a calibration setting, and said step of changing the adjusted flow rate calibration setting of one of said supply air blower and said fuel supply valve is performed by changing the adjusted flow rate calibration setting of said fuel supply valve.

12. The method of claim 9 wherein:

said step of adjusting the flow rate of one of said supply air blower and said fuel supply valve to a calibration setting is performed by adjusting the flow rate of said fuel supply valve to a calibration setting, and said step of changing the adjusted flow rate calibration setting of one of said supply air blower and said fuel supply valve is performed by changing the adjusted flow rate calibration setting of said fuel supply valve.

13. The method of claim 9 wherein:

said step of adjusting the flow rate of one of said supply air blower and said fuel supply valve to a calibration setting is performed by adjusting the flow rate of said fuel supply valve to a calibration setting, and said step of changing the adjusted flow rate calibration setting of one of said supply air blower and said fuel supply valve is performed by changing the adjusted flow rate calibration setting of said supply air blower.

* * * * *